United States Patent [19]

Rolland

[11] 4,264,780

[45] Apr. 28, 1981

[54] HEAT-RECOVERABLE ARTICLES

[75] Inventor: Claude A. Rolland, Aincourt, France

[73] Assignee: Raychem Pontoise S.A., Saint Ouen L'Aumone, France

[21] Appl. No.: 41,386

[22] Filed: May 22, 1979

[51] Int. Cl.[3] ..... H01R 4/02

[52] U.S. Cl. ..... 174/84 R; 174/DIG. 8

[58] Field of Search ..... 174/84 R, 78, DIG. 8

[56] References Cited

U.S. PATENT DOCUMENTS

| | | | |
|---|---|---|---|
| 3,200,190 | 8/1965 | Forney | 174/78 X |
| 3,305,625 | 2/1967 | Ellis | 174/84 R |

*Primary Examiner*—Roy N . Envall, Jr.
*Attorney, Agent, or Firm*—Lyon & Lyon

[57] ABSTRACT

A heat-recoverable article comprises a heat-shrinkable sleeve having an elongate electrical conductor retained therein. The conductor projects from at least one end of the sleeve and at least a portion of the length of the conductor within the sleeve is uninsulated, there being a quantity of solder, which is positioned eccentrically in the sleeve, on at least part of the said uninsulated portion. Articles wherein the conductor is an earth conductor may be used to connect the earth conductor to a substrate, for example the outer conductor of a coaxial cable, inserted into the sleeve.

18 Claims, 4 Drawing Figures

HEAT-RECOVERABLE ARTICLES

This invention relates to heat-recoverable articles, more especially to heat-shrinkable sleeves having solder therein.

It is known to make insulated soldered connections between a pair of electrical conductors by the use of a device which comprises a heat-shrinkable sleeve of insulating material which contains a ring of solder positioned at its central region. The sleeve may also be provided, at one or both ends, with a quantity of a fusible material, which melts when the sleeve is heated to cause recovery, and provides environmental sealing for the resulting connection. The fusible material may also serve to prevent escape of solder from the end of the sleeve or, if there is no fusible material provided, this may be achieved by the recovery of the ends of the sleeve around the conductors, or their insulation.

Heat-shrinkable sleeves containing solder, which are described in U.S. Pat. No. 3,243,211, the disclosures of which are incorporated by reference herein, have found many applications including, for example, the attachment of an earth conductor to the outer conductor of a coaxial cable. Thus for example U.S. Pat. No. 3,312,772 discloses a heat-shrinkable sleeve having a ring of solder therein and a ground lead (earth conductor) a portion of which is positioned between the solder ring and the sleeve.

The present invention is concerned with the provision of a heat-shrinkable sleeve containing solder, which is of use in making a connection between a first conductor, for example an earth conductor, and a second conductor, for example the outer conductor of a coaxial cable.

The present invention accordingly provides a heat-recoverable article comprising a heat-shrinkable sleeve having two open ends, the sleeve having retained therein an elongate electrical conductor, which projects from at least one end of the sleeve, at least a portion of the length of the conductor within the sleeve being uninsulated, the conductor being an earth conductor and being so positioned in the sleeve that the article can in use be positioned around an elongate substrate having external dimensions only slightly smaller than the internal dimensions of the sleeve with the substrate extending out of both ends of the sleeve, and a quantity of solder on at least part of the said uninsulated portion, the solder being positioned eccentrically within the sleeve and being such that it does not extend round the entire inner circumference of any cross-section of the sleeve.

The present invention further provides a heat-recoverable article comprising a heat-shrinkable sleeve having two open ends and having a substantially constant cross-section throughout its length, the sleeve having retained therein adjacent to the inner surface thereof an elongate electrical conductor which projects from at least one end of the sleeve, at least a portion of the length of the conductor within the sleeve being uninsulated, and a quantity of solder on at least part of the said uninsulated portion, the solder being positioned eccentrically within the sleeve and being such that it does not extend round the entire inner circumference of any cross-section of the sleeve.

It is not essential that the portion of the conductor outside the sleeve be insulated. Advantageously, however, the conductor is insulated except for a length within the sleeve that is to take part in making an electrical connection.

The present invention also provides a heat-recoverable article comprising a heat-shrinkable sleeve having retained therein an elongate insulated electrical conductor, which projects from at least one end of the sleeve, at least a portion of the length of the conductor within the sleeve being uninsulated, and a quantity of solder on at least part of the said uninsulated portion, the solder being positioned eccentrically within the sleeve and being such that it does not extend round the entire inner circumference of any cross-section of the sleeve.

It is to be understood that the portion of conductor having the quantity of solder positioned thereon is not merely a tinned portion of the conductor; that is, the term "quantity of solder" is used herein to mean that in at least one cross-section through the portion of the conductor which carries the solder the amount of solder is in excess of that normally present on a pretinned conductor. Thus the quantity of solder should be sufficient to flow and wet a substrate to which the conductor is to be connected and to make an electrical connection between the conductor and the substrate. Thus there should be a connection-effective solder quantity. Advantageously, in at least one cross-section through the portion of the conductor which carries the solder the thickness of the solder layer on the conductor is at least as great as the radius of the conductor.

The solder may be, if desired or required, associated with an appropriate flux. The quantity of solder is advantageously localised in the sleeve in the region of the conductor, and is preferably such as to permit the insertion in the article of an elongate substrate having exterior dimensions only slightly smaller than the inner dimensions of the sleeve. The quantity of solder is preferably held merely by its engagement with the conductor, without the need for cooperation between the conductor and any other member, for example the sleeve, although retention, or enhancement of retention, by such cooperation is not excluded and the solder may in any case contact the sleeve, if desired.

The quantity of solder may have any suitable form and may be maintained on the conductor in any suitable manner. Thus, for example, the solder may be in the form of a ball or other shape which completely surrounds a cross-section through the said portion of the conductor. Provided that it is firmly held thereon, however, the solder need not completely surround a cross-section through the said portion of the conductor. If desired, the quantity of solder may be provided merely by wrapping a strip of solder in an appropriate manner about the conductor and, whatever the shape of the quantity of solder the latter may, if appropriate, be crimped onto the conductor. If desired or required, the quantity of solder may include one or more outwardly extending portions, for example a pair of lugs, for enhancing the anchorage of the solder, and thus the conductor, in the sleeve; during manufacture of the article the sleeve may be partially recovered into engagement with one or more such outwardly extending portions.

The conductor also is advantageously so positioned in the sleeve as to permit the insertion in the sleeve of an elongate substrate having exterior dimensions only slightly smaller than the inner dimensions of the sleeve. Preferably the portion of the conductor within the sleeve extends in a direction which is substantially parallel to the axis of the sleeve, and advantageously the insulated portion(s) of the conductor within the sleeve abut(s) the inner surface of the sleeve. The article may of course comprise two or more elongate conductors, if desired.

The conductor may be retained in the sleeve in any suitable manner. It should be understood that provided the sleeve and conductor do not become separated from one another during normal handling, it is not essential that the various components be rigidly fixed relative to each other; some slight relative movement may be permissible.

Advantageously the conductor is held by cooperation between the inner surface of the sleeve and the outer surface of at least one insert positioned within the sleeve. The insert, which is preferably in the form of a ring or sleeve, may if desired be infusible at the temperature to which in use the article is heated to cause the sleeve to shrink and the solder to fuse, in which case it is advantageously heat-shrinkable, but it is preferably fusible at that temperature such that on installation of the article the fused insert material may assist in providing environmental sealing for the connection made. Advantageously the conductor is held by cooperation between the sleeve and at least two inserts, at least one insert being positioned between the portion of the conductor having the quantity of solder thereon and each end of the sleeve; in this case, the quantity of solder is not carried by the extreme end portion of the conductor. If only one insert is used the solder advantageously includes one or more outwardly extending portions for enhancing the anchorage of the solder, and thus the conductor in the sleeve.

A further method by which the conductor may be retained in the sleeve comprises partial recovery of the sleeve about the conductor. This method may, if desired, be combined with the method described above wherein the conductor is held by one or more inserts and/or with any other method.

As indicated above, the conductor is advantageously insulated except for a length thereof within the sleeve that is to take part in making an electrical connection. Advantageously the portion of the conductor which is to take part in making the electrical connection is not the extreme end portion, and a conductor which is insulated except in a region adjacent to, but not at, the end thereof is advantageously provided by incomplete removal of a short length of insulation resulting from cutting radially through the insulation at a point in the region of the end of the conductor. Thus, for example, the short length of insulation may be moved longitudinally over the conductor until a part only of the insulation extends beyond the end of the conductor; if desired the longitudinally extending part of the short length of insulation may be cut off so that the conductor and the separate length of insulation are conterminous. When the conductor is stranded, a short length of insulation remaining on the extreme end portion of the conductor may assist in maintaining the strands in the stripped portion close together and relatively straight. Where the extreme end portion of the conductor is insulated and the conductor is retained in the sleeve by a pair of inserts positioned on either side of the quantity of solder, each insert advantageously contacts an insulated portion of the conductor. During manufacture an insulated end portion of the conductor and an end of the sleeve may if desired contact a planar surface, making it possible to position the uninsulated portion of the conductor correctly without the need to hold the conductor in the desired place; this is particularly advantageous when the sleeve is positioned vertically during manufacture.

The heat-shrinkable sleeve used in accordance with the invention is a sleeve at least part of which will shrink on the application of heat and may comprise any material, advantageously an electrically insulating material, which may be converted to or maintained in a heat-shrinkable form. Examples of suitable materials are given in, for example, U.S. Pat. Nos. 3,086,242 and 3,297,819 and the other U.S. specifications the disclosures of all of which are incorporated by reference herein referred to in this specification, Crosslinked polymeric materials, for example crosslinked polyvinylidene fluoride, are particularly suitable. Where a sleeve comprising two or more layers is used, the inner layer(s) need not comprise the same material as the outer layer. The sleeve is advantageously sufficiently transparent to enable the soldered connection made therein to be inspected.

The sleeve may be extruded as such, or may be formed from a sheet of material (which may if desired be heat-shrinkable) opposite edges of the sheet being joined in any suitable manner, for example by the use of a peroxide, by use of a contact adhesive (for example as disclosed in U.S. Pat. No. 3,770,556), or by the use of an insert comprising a thermoplastic material and a heat-activatable crosslinking agent (see for example U.S. Pat. Nos. 3,891,490 and 3,927,233 and British Pat. Specification No. 1,512,727) to form the sleeve. If desired, the opposite edges of the sheet may be provided with means for making a connection between them (see for example U.S. Pat. Nos. 3,455,336, 3,379,218, 3,530,898 and 3,574,313). Where the sleeve is formed from a sheet of material, the sheet may if desired be shaped to hold the quantity of solder before formation of the sleeve. Heat-shrinkability may, if necessary, be imparted to a sleeve by any suitable method.

The heat-shrinkable sleeve may have any desired shape. One method by which a desired shaped may be imparted comprises partial recovery of the sleeve round one or more appropriately shaped mandrels. Where one or more inserts are present, these may be fixed in the sleeve in any appropriate manner, for example, by partial recovery of the sleeve over the insert(s) to make the latter a tight fit.

The sleeve may be open at one or both ends and may if desired be provided with a quantity of fusible material (for example fusible polymeric material) or other sealing material between the solder and the or each open end. Where the sleeve contains a fusible insert, this may form the quantity of fusible material. The fusible material may act as "dam" for the solder, preventing it from flowing out of the open end(s) of the sleeve during installation of the article and/or may enhance the environmental seal at the end(s) of the sleeve. Thus, the sleeve can force fused fusible material into close contact with a conductor received in the open end of the sleeve to provide a reliable seal. Alternatively, the sleeve and the fused fusible material could cooperate to produce a seal even at an open end that does not in use receive a substrate.

In a preferred embodiment of the invention there is provided an article comprising a heat-shrinkable sleeve having first and second open ends and having retained therein an elongate electrical conductor an insulated portion of which projects from a first open end of the sleeve and an insulated end of which is within the sleeve, a portion of the conductor between the insulated end thereof and the first end of the sleeve being uninsulated and having a quantity of solder thereon, the conductor advantageously being retained in the sleeve by cooperation between the sleeve and first and second fusible rings the outer surface of each of which contacts an insulated portion of the conductor, the first ring being positioned between the uninsulated portion of the conductor and the first end of the sleeve and the second ring being positioned being the uninsulated portion of the conductor and the second end of the sleeve.

The invention also provides a method of making an electrical connection which comprises positioning an article according to the invention over a substrate and heating to cause shrinkage of the sleeve and fusing of the solder to make an electrical connection between the electrical conductor and the substrate. Advantageously, the substrate is the outer conductor of a coaxial cable.

The article of the invention may readily be manufactured without the use of complicated tooling. As the article comprises a preinstalled conductor and quantity of solder, the connection of an earth conductor to, for example, the outer conductor of a coaxial cable may be effected merely by inserting the outer conductor in the article and heating; the article may thus readily be installed by an automatic process. Furthermore, the quantity of solder appropriate to a particular use may be selected during manufacture of the sleeve, and the fact that the solder is on the conductor and positioned eccentrically in the sleeve makes it possible to obtain a very good localized solder joint without the use of excess solder which may after fusing be present in undesired locations. Thus, for example, where an earth conductor is connected to the outer conductor of a coaxial cable, the use of the article of the invention may result in there being substantially equal amounts of solder on the earth conductor and on the outer conductor in the final assembly. Furthermore, because it is necessary to fuse only the amount of solder which is required to form the joint, a smaller amount of heat is required, thus lessening the risk of overheating, for example, the sleeve, which in turn may make it possible, if desired, to use solder of a higher melting point than would be possible if for example a complete ring of solder were used.

The above situation is in contrast to the situation in the case of, for example, a device as disclosed in U.S. Pat. No. 3,312,772 which contains a complete ring of solder. In the case of such a device it has now been found that a relatively large ring of solder and hence a relatively thick sleeve is in practice required if sufficient solder is to be present at the desired location (i.e. at the point where the connection is to be made between the earth conductor and the outer conductor), so that a considerable quantity of heat must be applied to ensure complete shrinking of the sleeve and fusing of the solder, with the attendant possibility of overheating. It has also now been found that the ring of solder in U.S. Pat. No. 3,312,772 provides much more solder than is needed to connect the earth conductor with the outer conductor. This is disadvantageous, not only because it wastes solder, but also because solder may reach locations in the completed connection where it should not be.

Various embodiments of the invention will now be described in greater detail, by way of example only, with reference to the accompanying drawing in which.

Figure 1:
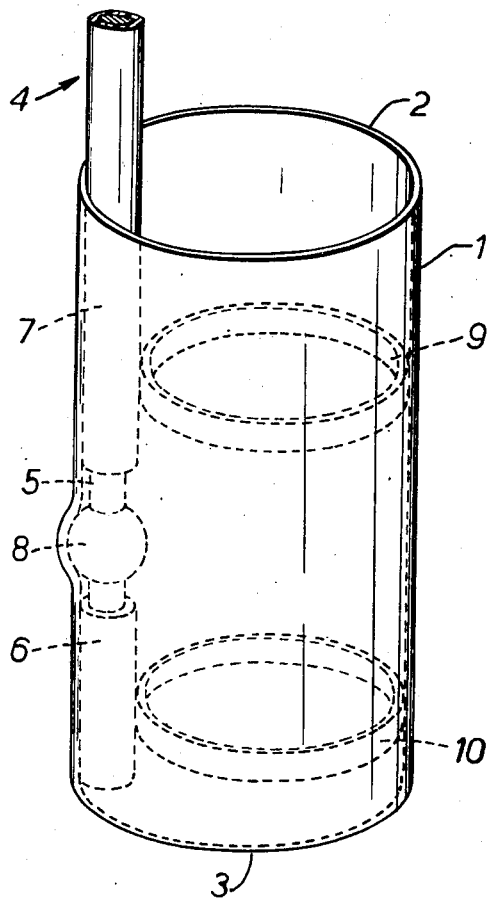
FIG. 1 is a perspective view of one embodiment of the invention.

Referring now to the drawings, a heat-shrinkable sleeve 1 has open ends 2 and 3 respectively. An insulated conductor indicated generally by the reference numeral 4 having an uninsulated portion 5 within the sleeve extends from the open end 2 of the sleeve. The end of the conductor 4 is insulated by a short length of insulation 6, and insulation 7 is present on the portion of the conductor 4 between the uninsulated portion 5 and the open end 2 of the sleeve. A ball 8 of solder surrounds part of the uninsulated portion 5 of the conductor 4.

The portion of the conductor 4 within the sleeve 1 extends in a direction which is generally parallel to the axis of the sleeve with the portions of insulation 6 and 7 (and the solder ball 8) contacting the inner surface of the sleeve. The conductor 4 is retained in position in the sleeve by cooperation between the sleeve and two rings of fusible material, 9 and 10 respectively. The ring 9 is positioned between the uninsulated portion 5 of the conductor and the open end 2 of the sleeve, a portion of insulation 7 being sandwiched between the outer surface of the ring 9 and the inner surface of the sleeve 1. Similarly, a portion of insulation 6 is sandwiched between the outer surface of the ring 10, which is positioned between the uninsulated portion 5 of the conductor and the open end 3 of the sleeve, and the inner surface of the sleeve. The sleeve has been partially recovered from a diameter greater than that shown, to fix the conductor 4 and the rings 9 and 10 in position so that they do not move significantly with respect to each other or to the sleeve 1.

In the embodiment of the invention shown in FIG. 1, the conductor and the solder thereon are close to the inner surface of the sleeve and thus permit the insertion in the sleeve of a substrate having exterior dimensions only slightly smaller than the internal dimensions of the sleeve. Such a substrate, for example a coaxial cable having an exposed length of outer conductor, may be inserted in the sleeve such that the said length of outer conductor is adjacent to solder ball 8 and the assembly may then be heated to cause the sleeve to shrink and the solder ball 8 and fusible rings 9 and 10 to fuse so that a soldered connection is made between the uninsulated portion 5 of the conductor 4 and the outer conductor of the coaxial cable and an enviromental seal is made, if desired. When, as shown in the drawings, the sleeve 1 is transparent the soldered connection may readily be inspected, but where such visual inspection is not necessary use of a transparent material is not essential.

Figure 2:
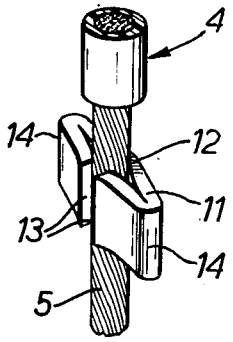
FIGS. 2 to 4 are perspective views showing electrical conductors for use in the article of the invention having quantities of solder of different shapes thereon.
Figure 3:
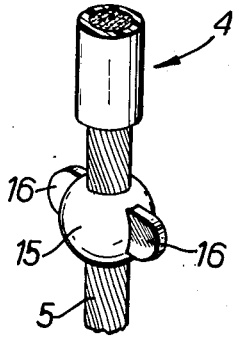
Figure 4:
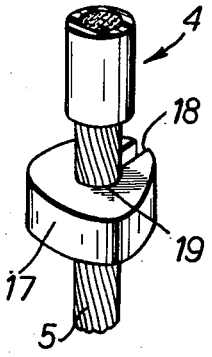

FIGS. 2 to 4 shows quanties of solder of different shapes on an uninsulated portion 5 of the conductor 4. The quantity of solder 11 shown in FIG. 2 is formed by crimping a strip of solder around the portion 5, the resultant quantity of solder being in cross-section, in the form of a compressed 'C'. Thus, in a cross-section through solder 11, the centre portion 12 and end portions 13 of the solder strip contact opposite sides of the conductor, with the end portions slightly spaced from each other, and the part of the strip between the central portion and each end portion is folded on itself to provide a pair of diametrically opposed outwardly extending portions 14 of solder each of which has, in cross-section, a lateral extent greater than the thickness of the solder strip.

FIG. 3 shows a quantity of solder in the form of a ball 15 provided with a pair of diametrically opposed outwardly extending lugs 16 which may, if the sleeve is partially recovered into engagement with at least one of them, enhance the anchorage of the conductor 4 in the sleeve 1. The quantity of solder 17 shown in FIG. 4 is substantially triangular in cross-section, and has a slit 18 therein whereby it is open in cross-section so that it can be forced onto the uninsulated portion 5 of the conductor 4; in the case of a stranded conductor this step may be facilitated by movement of the strands relative to one another. The slit 18 communicates with a central hole 19 in the solder 17, the dimensions of the hole being such that the solder 17 is held tightly on the conductor.

The quantities of solder shown in FIGS. 2 to 4 may if desired be used in an article as shown in FIG. 1 in place of the solder ball 8 used therein, or may be used in any other article constructed in accordance with the invention. One or both of the outwardly extending portions 14 in FIG. 2 and one or more of the apices of the triangle which is the cross-section through the quantity of solder 17 in FIG. 4 may if desired act in the same manner as the lugs 16 in FIG. 3, namely to enhance the anchorage of the solder, and hence the anchorage of the conductor 4 in the sleeve. One situation where such enhancement may be desirable is where the short length of insulation 6 in FIG. 1 is absent (which may be the case if, for example the uninsulated portion of the conductor is tinned), in which case the article may comprise only one ring of fusible material (for example ring 9 in FIG. 1, ring 10 being absent).

An article according to the invention may if desired comprise more than one preinstalled elongate electrical conductor having a quantity of solder thereon.

Examples of elongate electrical conductors which may be used in the article of the invention are earth conductors and electrically conductive pins, for example terminal pins.

It is to be understood that a sleeve which has a substantially constant cross-section throughout its length may have an additional portion, for example, an end portion, of a different cross-sectional shape and/or size provided that an appreciable part of the inner circumference of the additional portion is spaced to a significant extent from the conductor, that is, provided the additional portion is not recovered into close contact with the conductor.

I claim:

1. A heat-recoverable article comprising a heat-shrinkable sleeve having two open ends, the sleeve having retained therein an elongate electrical conductor, which projects from at least one end of the sleeve, at least a portion of the length of the conductor within the sleeve being uninsulated, the conductor being an earth conductor and being so positioned in the sleeve that the article can in use be positioned around an elongate substrate having external dimensions only slightly smaller than the internal dimensions of the sleeve with the substrate extending out of both ends of the sleeve, and a quantity of solder on at least part of the said uninsulated portion, the solder being positioned eccentrically within the sleeve and being such that it does not extend round the entire inner circumference of any cross-section of the sleeve.

2. A heat-recoverable article comprising a heat-shrinkable sleeve having two open ends and having a substantially constant cross-section throughout its length, the sleeve having retained therein adjacent to the inner surface thereof an elongate electrical conductor which projects from at least one end of the sleeve, at least a portion of the length of the conductor within the sleeve being uninsulated, and a quantity of solder on at least part of the said uninsulated portion, the solder being positioned eccentrically within the sleeve and being such that it does not extend round the entire inner circumference of any cross-section of the sleeve.

3. A heat-recoverable article comprising a heat-shrinkable sleeve having retained therein an elongate insulated electrical conductor, which projects from at least one end of the sleeve, at least a portion of the length of the conductor within the sleeve being uninsulated, and a quantity of solder on at least part of the said uninsulated portion, the solder being positioned eccentrically within the sleeve and being such that it does not extend round the entire inner circumference of any cross-section of the sleeve.

4. An article as claimed in claim 1, wherein the conductor is insulated except for a length within the sleeve that is to take part in making an electrical connection.

5. An article as claimed in claim 1, wherein the conductor projects from one end only of the sleeve and wherein the extreme end portion of the conductor within the sleeve is insulated.

6. An article as claimed in claim 1, wherein the quantity of solder is localized in the region of the conductor.

7. An article as claimed in claim 1, wherein the quantity of solder is crimped onto the conductor.

8. An article as claimed in claim 1, wherein the quantity of solder comprises a plurality of outwardly extending portions.

9. An article as claimed in claim 1, wherein the conductor is held by cooperation between the inner surface of the sleeve and a outer surface of at least one insert positioned within the sleeve.

10. An article as claimed in claim 9, wherein the said insert is fusible at the temperature to which in use the article is heated to cause shrinking of the sleeve and fusing of the solder.

11. An article as claimed in claim 9, wherein the insert is in the form of a ring.

12. An article as claimed in claim 9, wherein there are at least two inserts, at least one insert being positioned between the portion of the conductor having the quantity of solder thereon and each end of the sleeve.

13. An article as claimed in claim 12, wherein each insert contacts an insulated length of the conductor.

14. An article comprising a heat-shrinkable sleeve having first and second open ends and having retained therein an elongate electrical conductor an insulated portion of which projects from a first open end of the sleeve and an insulated end of which is within the sleeve, a portion of the conductor between the insulated end thereof and the first end of the sleeve being uninsulated and having a quantity of solder thereon.

15. An article as claimed in claim 14, wherein the conductor is retained in the sleeve by cooperation between the sleeve and first and second fusible rings the outer surface of each of which contacts an insulated portion of the conductor, the first ring being positioned between the uninsulated portion of the conductor and the first end of the sleeve and the second ring being positioned being the uninsulated portion of the conductor and the second end of the sleeve.

16. A method of making an electrical connection which comprises the steps of (a) selecting a heat-recoverable article comprising a heat-shrinkable sleeve having two open ends, the sleeve having retained therein an elongate electrical conductor, which projects from at least one end of the sleeve, at least a portion of the length of the conductor within the sleeve being uninsulated, the conductor being an earth conductor and being so positioned in the sleeve that the article can in use be positioned around an elongate substrate having external dimensions only slightly smaller than the internal dimensions of the sleeve with the substrate extending out of both ends of the sleeve, and a quantity of solder on at least part of the said uninsulated portion, the solder being positioned eccentrically within the sleeve and being such that it does not extend round the entire inner circumference of any cross-section of the sleeve;

(b) positioning the article over a substrate; and (c) heating to cause shrinkage of the sleeve and fusing of the solder to make an electrical connection between the conductor and the substrate.

17. A method as claimed in claim 16, wherein the substrate is the outer conductor of a coaxial cable.

18. A connection comprising a heat-recovered article comprising a heat-shrunk sleeve having two open ends, the sleeve having retained therein an elongate substrate and an elongate electrical conductor which projects from at least one end of the sleeve, at least a portion of the length of the conductor within the sleeve being uninsulated, the conductor being an earth conductor, the elongate substrate extending out of both ends of the sleeve, and a quantity of fused solder on at least part of the said uninsulated portion, the solder before fusing being positioned eccentrically within the sleeve and before fusing being such that it does not extend round the entire inner circumference of any cross-section of the sleeve.

* * * * *